US010520225B2

(12) United States Patent
Barjhoux et al.

(10) Patent No.: US 10,520,225 B2
(45) Date of Patent: Dec. 31, 2019

(54) REFRIGERATION AND/OR LIQUEFACTION DEVICE USING SELECTIVE PRE-COOLING, AND CORRESPONDING METHOD

(71) Applicant: L'Air Liquide, Societe Anonyme pour l'Etude et l'Exploitation des Procedes Georges Claude, Paris (FR)

(72) Inventors: Pierre Barjhoux, La Tronche (FR); Fabien Durand, Voreppe (FR); Vincent Heloin, Sassenage (FR); Jean-Marc Bernhardt, La Buisse (FR); Gilles Flavien, Grenoble (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 899 days.

(21) Appl. No.: 14/759,117

(22) PCT Filed: Nov. 8, 2013

(86) PCT No.: PCT/FR2013/052686
§ 371 (c)(1),
(2) Date: Jul. 2, 2015

(87) PCT Pub. No.: WO2014/106697
PCT Pub. Date: Jul. 10, 2014

(65) Prior Publication Data

US 2015/0345834 A1 Dec. 3, 2015

(30) Foreign Application Priority Data

Jan. 3, 2013 (FR) ..... 13 50018

(51) Int. Cl.
*F25B 9/00* (2006.01)
*F25B 9/14* (2006.01)
(Continued)

(52) U.S. Cl.
CPC ..... *F25B 9/14* (2013.01); *F25B 9/002* (2013.01); *F25B 9/10* (2013.01); *F25J 1/0065* (2013.01);
(Continued)

(58) Field of Classification Search
CPC .... F25B 9/00; F25B 9/002; F25B 9/02; F25B 9/06; F25B 9/10; F25B 9/12; F25B 9/14;
(Continued)

(56) References Cited

U.S. PATENT DOCUMENTS 3,389,565 A * 6/1968 Ergenc ..... F25J 1/0007 62/608
3,864,926 A * 2/1975 Collins ..... F25J 1/0007 505/888
7,278,280 B1 * 10/2007 Ganni ..... F25B 9/002 62/606

FOREIGN PATENT DOCUMENTS

FR 2 919 713 2/2009
JP S60165597 8/1985
(Continued)

OTHER PUBLICATIONS

International Search Report and Written Opinion for PCT/FR213/052686, dated Jan. 21, 2014.
(Continued)

*Primary Examiner* — Frantz F Jules
*Assistant Examiner* — Erik Mendoza-Wilkenfel
(74) *Attorney, Agent, or Firm* — Christopher J. Cronin

(57) ABSTRACT

Refrigeration device comprising a working circuit in a loop for the working gas and comprising, in series: a compression station, a cold box, a system for the exchange of heat between the cooled working gas and a point of use, a system for the additional pre-cooling of the working gas leaving the compression station comprising an auxiliary cryogenic fluid
(Continued)

volume, the cold box comprising a first cooling stage for the working gas comprising a first and a second heat exchanger, these being connected both in series and in parallel to the working circuit at the outlet of the compression station, the first cooling stage also comprising a third heat exchanger selectively exchanging heat with the auxiliary fluid, characterized in that the third heat exchanger is connected both in series and in parallel to the first and to the second heat exchangers, the working circuit comprising a recuperation pipe fitted with at least one valve and which connects the outlet of the third heat exchanger to the second heat exchanger.

12 Claims, 3 Drawing Sheets

(51) Int. Cl.

| | |
|---|---|
| ***F25B 9/02*** | (2006.01) |
| ***F25J 1/00*** | (2006.01) |
| ***F25B 9/10*** | (2006.01) |
| ***F25J 1/02*** | (2006.01) |

(52) U.S. Cl.
CPC ..... *F25J 1/0268* (2013.01); *F25J 2210/42* (2013.01); *F25J 2250/02* (2013.01); *F25J 2270/904* (2013.01); *F25J 2270/912* (2013.01)

(58) Field of Classification Search
CPC ..... F25B 27/00; F25B 5/02; F25B 5/04; F25J 1/0047; F25J 1/0055; F25J 1/0057; F25J 1/0007; F17C 2227/0309; F17C 2227/0374; F17C 2227/0395
See application file for complete search history.

(56) References Cited

FOREIGN PATENT DOCUMENTS

| | | |
|---|---|---|
| JP | S62102812 | 5/1987 |
| JP | S6332258 | 2/1988 |
| JP | S6338863 | 2/1988 |
| JP | S63194163 | 8/1988 |
| JP | H01127860 | 5/1989 |
| JP | H01244254 | 9/1989 |
| JP | H0436552 | 2/1992 |
| JP | H04273953 | 9/1992 |
| JP | H0579715 | 3/1993 |
| JP | H06123508 | 5/1994 |
| JP | H11125438 | 5/1999 |
| JP | 2004116433 | 4/2004 |
| JP | 2005273487 | 10/2005 |
| JP | 2007051565 | 3/2007 |
| JP | 2010536002 | 11/2010 |
| WO | WO 2011 110 768 | 9/2011 |
| WO | WO 2011 117 499 | 9/2011 |

OTHER PUBLICATIONS

French Search Report and Written Opinion for FR 1350018, dated Jul. 24, 2013.

Wagner, U., "Solutions for Liquid Nitrogen Pre-Cooling in Helium Refrigeration Cycles," Eighteenth International Cryogenic Engineering Conference (ICEC 18), Bombay Mumbai, India, Feb. 21-25, 2000.

* cited by examiner

REFRIGERATION AND/OR LIQUEFACTION DEVICE USING SELECTIVE PRE-COOLING, AND CORRESPONDING METHOD

CROSS-REFEREBCE TO RELATED APPLICATIONS

This application is a § 371 of International PCT Application PCT/FR2013/052686, filed Nov. 8, 2013, which claims § 119(*a*) foreign priority to French patent application 1350018, filed Jan. 3, 2013.

BACKGROUND

Field of the Invention

The present invention relates to a refrigeration and/or liquefaction device and to a corresponding method.

The invention relates more specifically to a device for the refrigeration and/or liquefaction of a working gas containing helium or consisting of pure helium, the device comprising a working circuit in the form of a loop for the working gas.

Related Art

The invention relates notably to helium refrigerators/liquefiers generating very low temperatures (for example 4.5K in the case of helium) with a view to continuously cooling users such as superconducting cables or components of a plasma generation device ("TOKAMAK"). What is meant by a refrigeration/liquefaction device is notably the very low-temperature (cryogenic temperature) refrigeration devices and/or liquefaction devices that cool, and where appropriate liquefy, a gas with a low molar mass such as helium.

When the point of use is cooled down, which means to say when the point of use needs to be brought down from a relatively high starting temperature (for example 300K or above) to a determined low nominal operating temperature (for example around 80K). The refrigeration/liquefaction device is generally ill-suited to such cooling.

What happens, when heavy components (such as superconducting magnets for example) are cooled from ambient temperature down to 80K over a lengthy period (over a few tens of days), relatively hot and cold streams of helium (feed toward the point of use and return from the point of use) pass countercurrentwise through common exchangers. For the device to operate correctly though, it is necessary to limit the difference in temperature between these streams of helium (for example to a maximum difference of between 40K and 50K).

To do so, the device comprises an auxiliary pre-cooling system which supplies negative calories during this cooling-down.

As illustrated notably in the article ("Solutions for liquid nitrogen pre-cooling in helium refrigeration cycles" by U. Wagner of CERN-2000), the pre-cooling system generally comprises a volume of liquid nitrogen (at constant temperature, for example 80K) which supplies negative calories to the working gas via at least one heat exchanger.

These known pre-cooling systems do, however, have constraints or disadvantages.

Thus, it is necessary to mix helium at 80K with hotter helium (at ambient temperature or the temperature at which it returns from the point of use that is to be cooled).

In order to limit the consumption of liquid nitrogen it is moreover necessary to recover the negative calories from the helium returning from the point of use that is to be cooled as the point of use is gradually cooled. These constraints on temperature difference and on performance require heat exchanger technologies that differ according to the various operating configurations (cooling-down, normal operation).

SUMMARY OF THE INVENTION

Thus, during normal operation (outside of the cooling-down phase), the exchangers need to have very high performance, i.e. low pressure drops and should not be faced with significant temperature differences. Heat exchangers suited to this normal operation comprise heat exchangers of the aluminum brazed plate and fin type. This type of exchanger can typically tolerate temperature differences of more than 50K between countercurrent fluids.

During the cooling-down of heavy users, the heat exchange performance required in the exchangers is not as high but remains high. By contrast, the temperature differences (because of the liquid nitrogen at constant temperature) become relatively great (greater than 50K).

When the helium temperatures in the circuits and exchangers are still high, the pressure drop is far greater than that required in normal operation.

Existing solutions for addressing these problems entail a main exchanger at the entrance to the cold box which provides an exchange of heat between the helium and the nitrogen. Other solutions make provision for this main exchanger to be split into several independent sections produced using different heat exchanger technologies according to the nature of the fluid (helium or nitrogen).

These solutions do not provide a satisfactory solution to the problems because the device is either ill-suited to normal operation or ill-suited to the cooling-down phase.

It is an object of the present invention to alleviate all or some of the prior art To this end, there is disclosed a device for the refrigeration and/or liquefaction of a working gas containing helium or consisting of pure helium, the device comprising a working circuit in the form of a loop for the working gas and comprising, in series:

- a working gas compression station equipped with at least one compressor,
- a cold box for cooling the working gas and comprising a plurality of heat exchangers arranged in series and at least one member for expanding the working gas,
- a system for the exchange of heat between the cooled working gas and a point of use, at least one return pipe returning to the compression station the working gas that has passed through the heat exchange system, the return pipe comprising at least one exchanger for warming the working gas, the device further comprising an additional system for pre-cooling the working gas at the exit from the compression station, the pre-cooling system comprising a volume of auxiliary cryogenic fluid such as liquid nitrogen, the volume being connected to the working circuit via at least one heat exchanger in order selectively to transfer negative calories from the auxiliary fluid to the working gas, the cold box comprising a first working-gas cooling stage comprising a first and a second heat exchanger which are connected both in series and in parallel to the working circuit at the outlet of the compression station, which means to say that the working gas leaving the compression station can be admitted selectively to the first and/or to the second heat exchanger, the first cooling stage also comprising a third heat exchanger selectively in a heat-exchange relationship with the auxiliary fluid. The third heat exchanger is connected both in series and in parallel to the first and second heat exchangers, which means to say that the working gas leaving the first and/or the second heat exchanger is admitted selectively to the third heat exchanger, the working circuit comprising a recovery pipe fitted with at least one valve and which connects the outlet of the third heat exchanger to the second heat exchanger so as to allow, selectively, the transfer of negative calories from the working gas leaving the third heat exchanger to the second heat exchanger.

Moreover, some embodiments of the invention may comprise one or more of the following features:

- of the following: the first, the second and the third heat exchanger, at least one is an aluminum exchanger of the plate and fin type,
- the third heat exchanger is a heat exchanger immersed at least partially in the volume of auxiliary fluid,
- the third heat exchanger is an exchanger remote from the volume and fed selectively with auxiliary fluid via a circuit comprising at least one feed pipe,
- the device comprises a pipe for discharging the vaporized auxiliary gas, connecting an upper end of the volume to a remote recovery system via a passage in the second heat exchanger, so as selectively to transfer negative calories from the vaporized gaseous auxiliary fluid to the working gas,
- at the outlet of the third heat exchanger the working circuit comprises a limited portion subdivided into two parallel lines of which one of the two lines constitutes the recovery pipe, said portion comprising a collection of valve(s) to ensure selective distribution between the two parallel lines,
- the recovery pipe, having passed through the third heat exchanger, is connected downstream to the working circuit of the cold box so as to continue the cooling of the working gas,
- the first and a second heat exchangers are connected both in series and in parallel to the working circuit at the exit of the compression station via a network of pipes and valves that form a parallel connection and a series connection between the two heat exchangers and a bypass line bypassing the first heat exchanger,
- the volume is selectively fed with auxiliary fluid via a conveying pipe connected to a source of auxiliary fluid and equipped with a valve,
- the first heat exchanger is of the type that exchanges heat between different streams of working gas at different respective temperatures and comprises a first passage fed with what is referred to as hot high-pressure working gas leaving the compression station, a second passage countercurrent to the first passage and fed by the return pipe for working gas said to be cold and at low pressure and a third passage countercurrent with the first passage and fed with working gas said to be at medium pressure via a working circuit return pipe returning working gas from the cold box which has not passed through the heat exchange system,
- the second heat exchanger is of the type that exchanges heat between the working gas and the auxiliary gas and comprises a first passage fed with working gas coming from the first heat exchanger and/or coming directly from the cold box, a second passage, countercurrent to the first passage and fed with vaporized auxiliary gas via the discharge pipe, a third passage fed with working gas via the recovery pipe,
- the working-fluid outlets of the first and second heat exchangers and the bypass line bypassing the first heat exchanger are connected in parallel to the working-fluid inlet of the third exchanger via a network of pipes and valves so that the third heat exchanger receives working fluid coming selectively either from the first heat exchanger only and/or working fluid coming from the second heat exchanger only and/or working fluid that has passed through the first then the second heat exchanger.

The invention also relates to a method of cooling a point of use using a device for the refrigeration and/or liquefaction of a working gas in accordance with any one of the features above or below, in which the point of use is cooled via the heat-exchange system, the method involving a step of pre-cooling the point of use having an initial temperature of between 120K and 400K, in which step the working gas leaving the compression station is cooled by exchange of heat in the first heat exchanger then in the second heat exchanger and then in the third heat exchanger, the cooled working gas leaving the third exchanger being readmitted at least in part upstream into the second heat exchanger where it gives up negative calories.

Moreover, some embodiments of the invention may comprise one or more of the following features:

- the point of use is cooled via the heat-exchange system, the method involving a step of pre-cooling the point of use having an initial temperature of between 50K and 200K, in which step the working gas leaving the compression station is cooled by exchange of heat in the first heat exchanger, then in the second heat exchanger and then in the third heat exchanger, the cooled working gas leaving the third exchanger being directed downstream of the working circuit into the cold box without returning upstream via the second heat exchanger,
- the point of use is cooled via the heat-exchange system, the method comprising a step of pre-cooling the point of use having an initial temperature of between 90 and 400K, after the pre-cooling step when the point of use reaches a temperature of between 50 and 90K, the method then comprises a step of continuous cooling of the point of use in which step the working gas leaving the compression station is split into two fractions which are cooled by exchange of heat in the first heat exchanger and in the second heat exchanger respectively, the two gas fractions then being recombined and cooled in the third heat exchanger, the cooled working gas leaving the third heat exchanger being directed downstream of the working circuit into the cold box without returning upstream via the second heat exchanger,
- the method involves a step of recovering at least part of the vaporized auxiliary fluid and a step of transferring negative calories from this vaporized auxiliary fluid to the working gas in the second heat exchanger.

The invention may also relate to any alternative device or method comprising any combination of the features above or below.

BRIEF DESCRIPTION OF THE FIGURES

Further specifics and advantages will become apparent from reading the description hereinafter given with reference to the figures in which.

DETAILED DESCRIPTION

Figure 1:
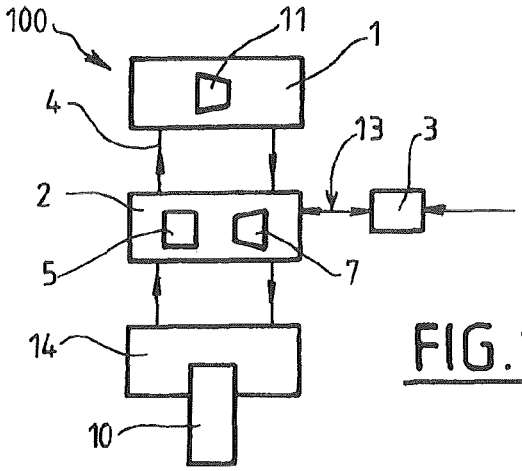
FIG. 1 depicts a simplified schematic and partial view illustrating the structure of a liquefaction/refrigeration device used for cooling a point of use member, FIG. 2 schematically and partially depicts a first example of a structure and operation of a liquefaction/refrigeration device used for cooling a point of use member, FIG. 3 schematically and partially depicts a detail of the cold box of a liquefaction/refrigeration device according to a second embodiment.

As depicted in FIG. 1, the plant 100 may in the conventional way comprise a refrigeration/liquefaction device comprising a working circuit subjecting the helium to a cycle of work in order to produce cold. The working circuit of the refrigeration device 2 comprises a compression station 1 equipped with at least one compressor 5 and preferably several compressors which compress the helium.

On leaving the compression station station 1 the helium enters a cold box 2 for cooling the helium. The cold box 2 comprises several heat exchangers 5 which exchange heat with the helium in order to cool the latter. In addition, the cold box 2 comprises one or more turbines 7 to expand the compressed helium. For preference, the cold box 2 operates on a thermodynamic cycle of the Brayton type or any other appropriate cycle. At least some of the helium is liquefied on leaving the cold box 2 and enters a heat-exchange system 14 designed to provide a selective exchange of heat between the liquid helium and a point of use 10 that is to be cooled. The point of use 10 comprises, for example, a magnetic-field generator obtained using a superconducting magnet and/or one or more cryocondensation pumping units or any other member requiring very-low-temperature cooling.

As indicated schematically in FIG. 1, the device further comprises, in a way known per se, an additional pre-cooling system for pre-cooling the working gas at the exit from the compression station 2. The pre-cooling system comprises a volume 3 of auxiliary cryogenic fluid such as liquid nitrogen. The volume 3 is connected to the working circuit via at least one heat exchanger in order selectively to transfer negative calories from the auxiliary fluid to the working gas.

Figure 3:
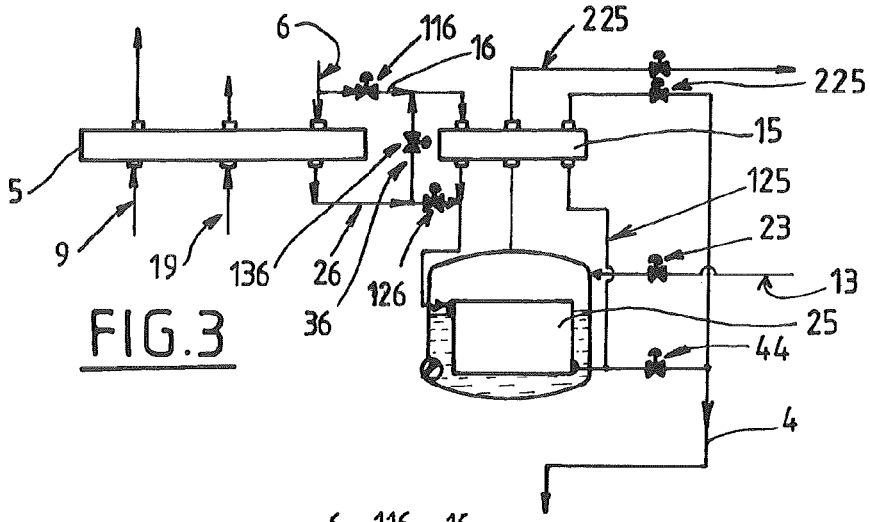

For example, the volume 3 may be fed with auxiliary fluid via a conveying pipe 13 connected to a source of auxiliary fluid (not depicted) and fitted with a valve 23 (cf. FIG. 3).

Figure 2:
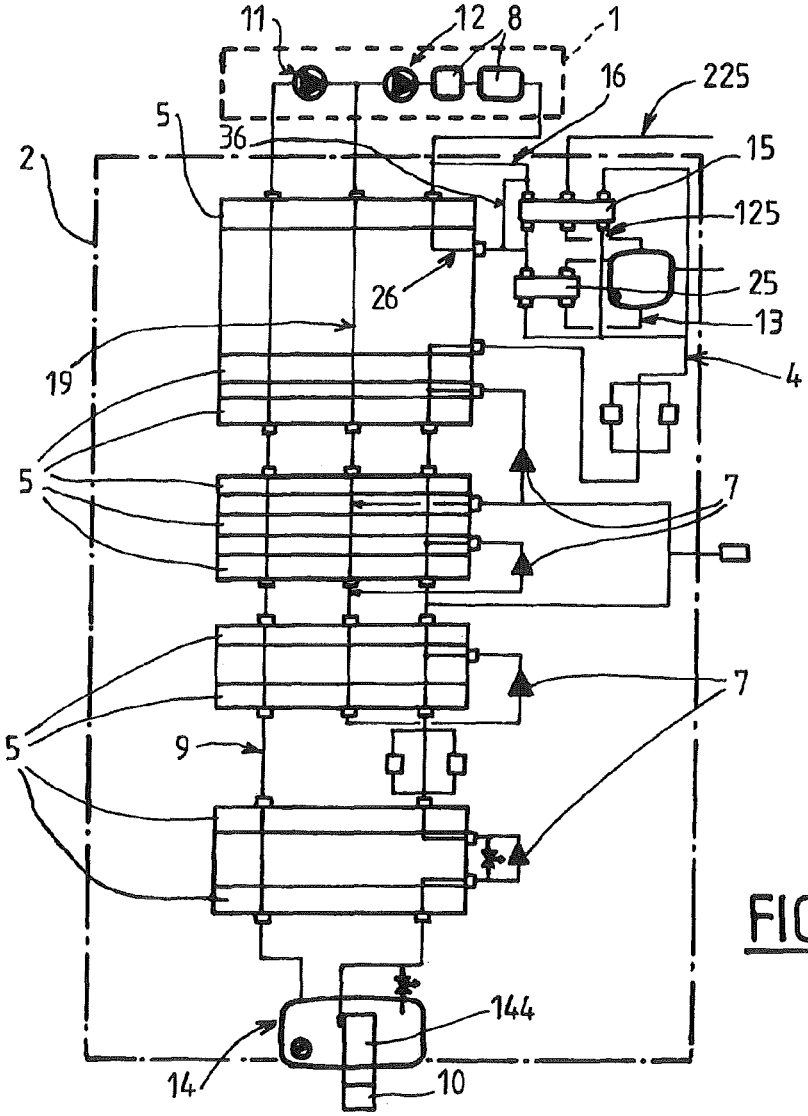

In the more detailed example of FIG. 2, the compression station 1 comprises two compressors 11, 12 in series defining for example three pressure levels for the helium. As indicated schematically, the compression station 2 may also comprise helium purification members 8.

At the exit from the compression station 1, the helium is admitted to a cold box 2 in which this helium is cooled by exchange of heat with several exchangers 5 and in which it is expanded through the turbines 7.

The helium liquefied in the cold box 2 can be stored in a reservoir 14 provided with an exchanger 144 intended to exchange heat with the point of use 10 that is to be cooled, (for example a circuit equipped with a pump). This system 14 for the exchange of heat between the helium and the point of use 10 may comprise any other appropriate structure.

The low-pressure helium that has passed through the heat exchange system 14 is returned to the compression station 1 via a return pipe 9 in order to recommence a cycle of work. During this return, the relatively cold helium gives up negative calories to the heat exchangers 5 and thus cools the relatively hot helium which is cooled and expanded in the opposite direction before reaching the point of use 10.

As illustrated, the working circuit may comprise a return pipe 19 returning to the compression station 1 helium from the cold box 2 that has not passed through the heat-exchange system 14.

As visible in FIG. 2, the device comprises a pre-cooling system comprising a volume 13 of auxiliary cryogenic fluid such as liquid nitrogen at a temperature of 80K for example.

The cold box 2 comprises a first helium-cooling stage which receives helium as soon as it leaves the compression station 1.

This first cooling stage comprises a first heat exchanger 5 and a second heat exchanger 15 which are connected both in series and in parallel to the working circuit at the outlet of the compression station 1. That means to say that the working gas leaving the compression station 2 can be admitted selectively to the first 5 and/or to the second 15 heat exchanger.

The first heat exchanger 5 is, for example, of the type in which there is an exchange of heat between different streams of helium at different respective temperatures. The first exchanger 5 may comprise a first passage 6 fed with working gas referred to as hot and at high pressure directly leaving the compression station 1, a second passage countercurrent to the first passage and fed by the return pipe 9 with working gas said to be cold and at low pressure, and a third passage countercurrent with the first passage and fed with working gas said to be at medium pressure via a return pipe 19.

The second heat exchanger 15 is of the type that exchanges heat between the working gas and the auxiliary gas and comprises for example a first passage 16 fed with working gas coming from the first heat exchanger 5 and/or coming directly from the cold box 2, a second passage, countercurrent with the first passage and intended for vaporized auxiliary gas, and a third passage fed with working gas via the recovery pipe 125.

As illustrated in the example of FIG. 3, the first 5 and a second 15 heat exchanger may be connected both in series and in parallel to the working circuit at the outlet of the compression station 1 via a network of pipes 6, 16, 26, 36 and of valves 116, 126, 136, forming:

- a parallel connection between the two heat exchangers 5, 15,
- a series connection between the two heat exchangers 5, 15 and
- a bypass line bypassing the first heat exchanger 5.

The first cooling stage also comprises a third heat exchanger 25. This third heat exchanger 25 is connected both in series and in parallel to the first 5 and to the second 15 heat exchanger. What this means to say is that the working gas leaving the first 5 and/or the second 15 heat exchanger is admitted selectively to the third heat exchanger 25. As illustrated for example in greater detail in FIG. 3, this is obtained by connecting a fluid inlet of the third heat exchanger 25 to two fluid outlets belonging respectively to the first 5 and second 15 heat exchanger.

As illustrated in FIG. 1, the working circuit comprises a recovery pipe 125 which selectively connects the outlet of the third heat exchanger 25 to the second heat exchanger 15 in order selectively to allow the transfer of negative calories from the working gas leaving the third heat exchanger 25 to the second heat exchanger 15.

For example, at the helium outlet of the third heat exchanger 25, the working circuit comprises a limited portion subdivided into two parallel lines of which one of the two lines constitutes the recovery pipe 125. This circuit portion may comprise a collection of valves 225, 44 to ensure selective distribution of the helium between the two parallel lines (cf. FIG. 3).

In addition, the recovery pipe 125, having passed through the third heat exchanger 25, is connected downstream to the working circuit of the cold box 2 so as to continue the cooling of the working gas.

The third heat exchanger 25 is fed selectively with auxiliary fluid (for example nitrogen). For example, the third heat exchanger 25 is an exchanger remote from the volume 3 and fed selectively with auxiliary fluid via a circuit comprising at least one feed pipe 13. This allows negative calories to be transferred selectively from the auxiliary fluid to the helium within the third heat exchanger 25.

As visible in FIG. 2, the device preferably comprises a discharge pipe 225 for the vaporized auxiliary gas, connecting an upper end of the volume 3 to a remote recovery system via a passage in the second heat exchanger 15. This allows negative calories to be transferred selectively from the vaporized gaseous auxiliary fluid to the working gas passing through the second heat exchanger 15.

FIG. 3 illustrates an alternative form of embodiment of the first cooling stage of the device. The form of embodiment of FIG. 3 differs from that of FIG. 2 only in that the third heat exchanger 25 is this time immersed in the volume of auxiliary fluid.

Figure 4:
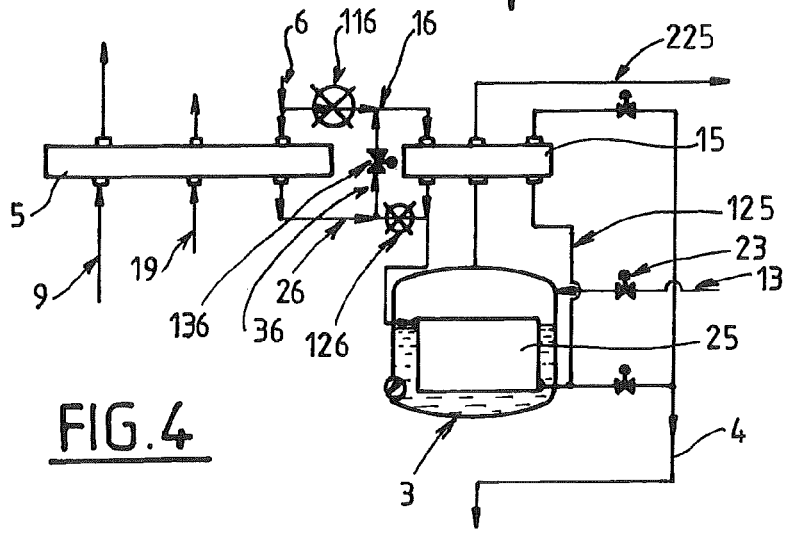
FIG. 4 depicts the detail of FIG. 3 in a particular operating configuration.
Figure 5:
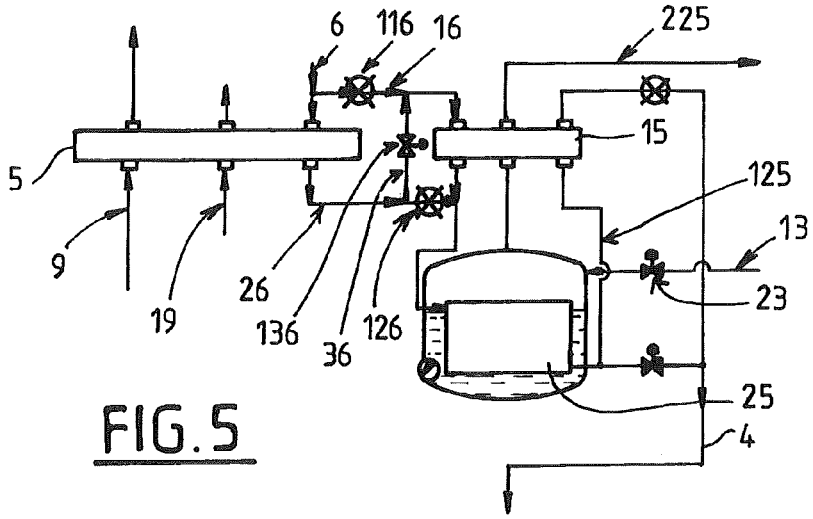
FIG. 5 depicts the detail of FIG. 3 in another particular operating configuration.
Figure 6:
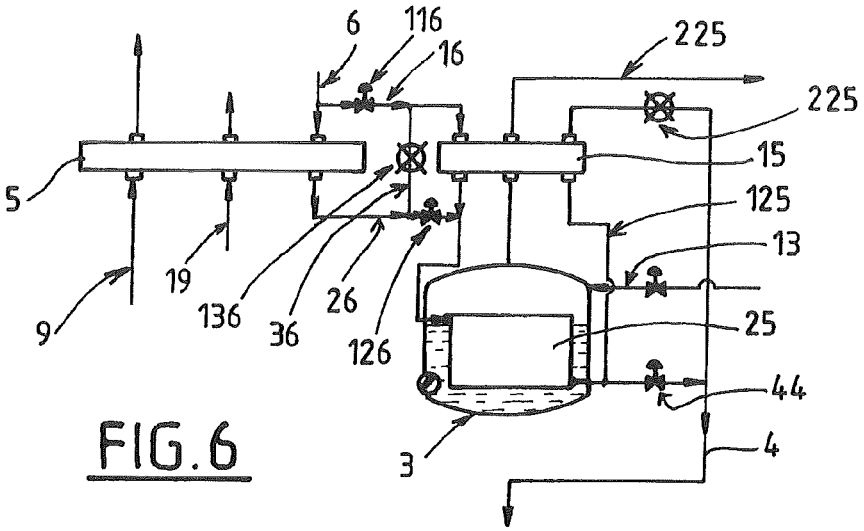
FIG. 6 depicts the detail of FIG. 3 in yet another particular operating configuration.

FIGS. 4 to 6 are three distinct configurations that can be employed in a succession of one possible example of operation of the device.

In a first phase of cooling down a point of use, which phase is illustrated in FIG. 4, the helium coming from the compression station 1 is cooled in series in the first 5, second 15 and third 25 heat exchangers in succession (valves 116 and 126 closed, valve 136 open). In addition, at the exit from the third heat exchanger 25, the cooled helium returns to pass through the second heat exchanger 15 via the recovery pipe 125 (valves 225 and 44 open).

The auxiliary fluid (nitrogen), at a temperature of around 80K, is allowed to circulate through the second heat exchanger 25 (it reemerges therefrom at a temperature of around 270K for example).

This may correspond to the start of an operation of cooling down a point of use initially at a temperature of 300K. During this first phase, the temperature of the helium may be:

- approximately equal to 300K at the exit from the first heat exchanger 5,
- approximately equal to 110K at the exit from the second heat exchanger 15,
- approximately equal to 80K at the exit from the third heat exchanger 25,
- approximately equal to 154K downstream 4 of the first cooling stage.

A second phase of cooling down a point of use having a temperature of 200K may involve the same configuration as that of FIG. 4.

During this second phase, the temperature of the helium may be:

- approximately equal to 200K at the exit from the first heat exchanger 5,
- approximately equal to 110K at the exit from the second heat exchanger 15,
- approximately equal to 80K at the exit from the third heat exchanger 25,
- approximately equal to 154K downstream 4 of the first cooling stage.

In this second phase, the auxiliary fluid (nitrogen) at a temperature of around 80K is allowed to circulate through the second heat exchanger 15 and reemerges therefrom at a temperature of around 190K for example.

A third phase of cooling down a point of use having a temperature of 140K may involve the same configuration as that of FIG. 4.

During this third phase, the temperature of the helium may be:

- approximately equal to 140K at the exit from the first heat exchanger 5,
- approximately equal to 115K at the exit from the second heat exchanger 15,
- approximately equal to 80K at the exit from the third heat exchanger 25,
- approximately equal to 96K downstream 4 of the first cooling stage.

In this third phase, the auxiliary fluid (nitrogen) at a temperature of around 80K is allowed to circulate through the second heat exchanger 15 and reemerges therefrom at a temperature of around 140K for example.

A fourth phase of cooling down the point of use having a temperature of 120K may involve a configuration that differs from that of FIG. 4 only in that the helium leaving the third heat exchanger 25 is not recirculated through the second heat exchanger 15 (valve 225 closed).

During this fourth phase, the temperature of the helium may be:

- approximately equal to 120K at the exit from the first heat exchanger 5,
- approximately equal to 115K at the exit from the second heat exchanger 15,
- approximately equal to 80K at the exit from the third heat exchanger 25,
- approximately equal to 80K downstream 4 of the first cooling stage.

In this fourth phase, the auxiliary fluid (nitrogen) at a temperature of around 80K is allowed to circulate through the second heat exchanger 15 and reemerges therefrom at a temperature of around 120K for example.

Finally, after this pre-cooling process, when the point of use has reached its low nominal operating temperature (for example 80K), the device may adopt a fifth phase of operation illustrated in FIG. 6.

This fifth phase of operation, referred to as "nominal" or normal (which means to say stabilized), differs from the configuration of FIG. 5 only in that the helium from the compression station 1 is distributed between the first 5 and second 15 heat exchangers (valves 116 and 126 closed while valve 136 is open).

During this fifth phase, the temperature of the helium may be:

- approximately equal to 86K before entering the third heat exchanger 25,
- approximately equal to 80K at the exit from the third heat exchanger 25.

In this fifth phase, the auxiliary fluid (nitrogen) at a temperature of approximately 80K is allowed to circulate through the second heat exchanger 15 and reemerges therefrom at a temperature of around 300K for example.

The architectures described hereinabove thus make it possible to cool down a massive component from a relatively hot temperature (for example 400K) to a relatively low temperature (for example 80K) with the same amount of equipment as is necessary for the normal (nominal) operation of the refrigerator/liquefier.

Indeed, the three exchangers 5, 15 and 25 may advantageously be heat exchangers of the same type, for example aluminum plate and fin exchangers. This makes it possible to use compact exchangers 5, 15, 25 and do so effectively for all modes of operation of the device (cooling down or normal operation).

This architecture in particular makes it possible to reduce the size of the first heat exchanger 5 by comparison with known systems. Specifically, this first heat exchanger 5 accepts only helium (not nitrogen). In addition, the flow rate of high-pressure helium (coming from the compression station 1) can be reduced therein in part by distributing some of this helium to the second heat exchanger 15.

In addition, the relatively hot and cold flows of helium are not fully balanced, which means to say that the cold flows lead to an increase in the pinch, which means to say an increase in the minimum temperature difference between the cold fluids and the hot fluids along the exchanger and an increase in the LMTD, namely an increase in the logarithmic mean temperature difference of the heat exchanger 5. Specifically, proportionately, the negative calories provided by the cold flows become greater than the heat energy to be extracted from the hot flow. The cold flows therefore undergo less warming, hence increasing the LMTD of the heat exchanger 5.

In normal operation, the first 5 and the second 15 exchanger operate in parallel (FIG. 6). During cooling down, these two exchangers 5, 15 by contrast operate in series.

This arrangement makes it possible to reduce the temperature differences at the second heat exchanger 15 because of the helium transferred into the second exchanger 15 by the recovery pipe 125.

This helium from the recovery pipe 125 is warmed up, giving up negative calories to the second heat exchanger 15 and is then mixed with the relatively cold flow of helium departing in the downstream direction in the cold box.

The device offers numerous advantages over the prior art.

Thus, the device notably makes it possible to specify the first 5, second 15 and third 25 exchangers for the normal operation of the refrigerator and these may thus consist of aluminum plate and fin type exchangers.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claims is an open transitional term which means the subsequently identified claim elements are non exclusive listing i.e. anything else may be additionally included and remain with the scope of "comprising." "Comprising" is defined herein as necessarily encompassing the more limited transitional terms "consisting essentially of" or "consisting of" and remain within the expressly defined scope of "comprising".

"Providing" in a claim is defined to mean furnishing, supplying making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations with said range.

All references identified herein are each hereby incorporated by reference into this application in their entireties, as well as for the specific information for which each is cited.

In addition, the device allows a simple and effective way of regulating the temperature of the helium according to the mode of operation.

What is claimed is:

1. A device for the refrigeration and/or liquefaction of a working gas containing helium or consisting of pure helium, the device comprising a working circuit in the form of a loop for the working gas and comprising, in series:

a working gas compression station equipped with at least one compressor, a cold box for cooling the working gas and comprising a plurality of heat exchangers arranged in series and at least one turbine for expanding the working gas, a system for an exchange of heat between the cooled working gas and a point of use, at least one return pipe returning to the compression station the working gas that has passed through the system for the exchange of the exchange of heat between the cooled working gas and the point of use, at least one return pipe comprising at least one exchanger for warming the working gas, the device further comprising an additional system for pre-cooling the working gas at the exit from the compression station, the additional system comprising a volume of auxiliary cryogenic fluid, the volume being connected to the working circuit via at least one heat exchanger in order to selectively transfer negative calories from the auxiliary cryogenic fluid to the working gas using a plurality of valves, the cold box comprising a first working-gas cooling stage comprising a first and a second heat exchanger which are connected both in series and in parallel, using the plurality of valves, to the working circuit at the outlet of the compression station, such that the working gas leaving the compression station can be admitted selectively, using the plurality of valves, to the first and/or to the second heat exchanger, the first cooling stage also comprising a third heat exchanger selectively in a heat-exchange relationship with the auxiliary fluid, such that the third heat exchanger is connected both in series and in parallel to the first and second heat exchangers, such that the gas leaving the first and/or the second heat exchanger is admitted selectively, using the plurality of valves, to the third heat exchanger, wherein the working circuit comprises a recovery pipe fitted with at least one recovery valve and which connects an outlet of the third heat exchanger to the second heat exchanger so as to allow, selectively, the transfer of negative calories from the working gas leaving the third heat exchanger to the second heat exchanger.

2. The device of claim 1, wherein at least one of the first, the second and the third heat exchanger is an aluminum exchanger of the plate and fin type.

3. The device of claim 1, wherein the third heat exchanger is a heat exchanger immersed at least partially in the volume of auxiliary cryogenic fluid.

4. The device of claim 1, wherein the third heat exchanger is an exchanger remote from the volume and fed selectively with the auxiliary cryogenic fluid via a circuit comprising at least one feed pipe.

5. The device of claim 1, further comprising a discharge pipe for discharging a vaporized auxiliary cryogenic fluid that connects an upper end of the volume) to a remote recovery system via a passage in the second heat exchanger so as selectively to transfer negative calories from the vaporized auxiliary cryogenic fluid to the working gas.

6. The device of claim 1, wherein, at the outlet of the third heat exchanger the working circuit comprises a limited portion subdivided into two parallel lines of which one of the two lines constitutes the recovery pipe, said limited portion comprising a collection of valve(s) to ensure selective distribution between the two parallel lines.

7. The device of claim 1, wherein the recovery pipe, having passed through the third heat exchanger, is connected downstream to the working circuit of the cold box so as to continue the cooling of the working gas.

8. A method of cooling a point of use using a device for the refrigeration and/or liquefaction of a working gas of claim 1, in which the point of use is cooled via the heat-exchange system.

9. The method of claim 8, wherein the method involves a step of pre-cooling the point of use having an initial temperature of between 120K and 400K, in which step the working gas leaving the compression station is cooled by exchange of heat in the first heat exchanger then in the second heat exchanger then in the third heat exchanger, and in that at least part of the cooled working gas leaving the third exchanger is readmitted upstream into the second heat exchanger where it gives up negative calories.

10. The cooling method of claim 8, wherein the method involves a step of pre-cooling the point of use having an initial temperature of between 50K and 200K, in which step the working gas leaving the compression station is cooled by exchange of heat in the first heat exchanger, then in the second heat exchanger and then in the third heat exchanger, and in that the cooled working gas leaving the third exchanger is directed downstream of the working circuit into the cold box without returning upstream via the second heat exchanger.

11. The cooling method of claim 8, wherein the method comprises a step of pre-cooling the point of use having an initial temperature of between 90 and 400 K, and in that, after the pre-cooling step when the point of use reaches a temperature of between 50 and 90 K, the method then comprises a step of continuous cooling of the point of use in which step the working gas leaving the compression station is split into two fractions which are cooled by exchange of heat in the first heat exchanger and in the second heat exchanger respectively, the two gas fractions then being recombined and cooled in the third heat exchanger, and in that the cooled working gas leaving the third heat exchanger is directed downstream of the working circuit into the cold box without returning upstream via the second heat exchanger.

12. The method of claim 8, wherein it involves a step of recovering at least part of a vaporized auxiliary cryogenic fluid and a step of transferring negative calories from the vaporized auxiliary cryogenic fluid to the working gas in the second heat exchanger.

* * * * *